United States Patent [19]

Eigenmann

[11] 4,102,718

[45] Jul. 25, 1978

[54] METHOD AND DEVICES FOR APPLYING TAPE MARKING MATERIAL ON ROAD SURFACES

[76] Inventor: Ludwig Eigenmann, Vacallo, Ticino, Switzerland

[21] Appl. No.: 758,693

[22] Filed: Jan. 12, 1977

[30] Foreign Application Priority Data

Jan. 12, 1976 [IT] Italy ..... 19163A/76
Nov. 17, 1976 [IT] Italy ..... 29453A/76

[51] Int. Cl.[2] ..... E04B 2/00; B32B 7/14; E01C 23/16

[52] U.S. Cl. ..... 156/71; 156/291; 404/94

[58] Field of Search ..... 156/71, 295, 290.1; 404/94; 427/137, 207 B, 358

[56] References Cited

U.S. PATENT DOCUMENTS 2,546,308 3/1951 Kahler ..... 404/94
3,850,670 11/1974 Gregory et al. ..... 427/358
3,902,939 9/1975 Eigenmann ..... 156/71
3,964,835 6/1976 Eigenmann ..... 156/323

*Primary Examiner*—Douglas J. Drummond
*Attorney, Agent, or Firm*—Michael J. Striker

[57] ABSTRACT

There is described a new method for forming dividing lines and other directional data upon the surface or pavement, by means of a base or "primer" layer of generally thermoplastic composition compatible with that of usual road pavements and forming an intermediate layer between the marking tape and the said road pavement, the new method comprising preliminarily applying or forming a primer layer on the lower face of the tape material to provide a two-layer structure, and then applying the thus formed structure to the road pavement, means and steps being provided for ensuring a prompt, complete and firm bonding at the tape-primer layer and at the primer layer-road pavement interfaces.

7 Claims, 7 Drawing Figures

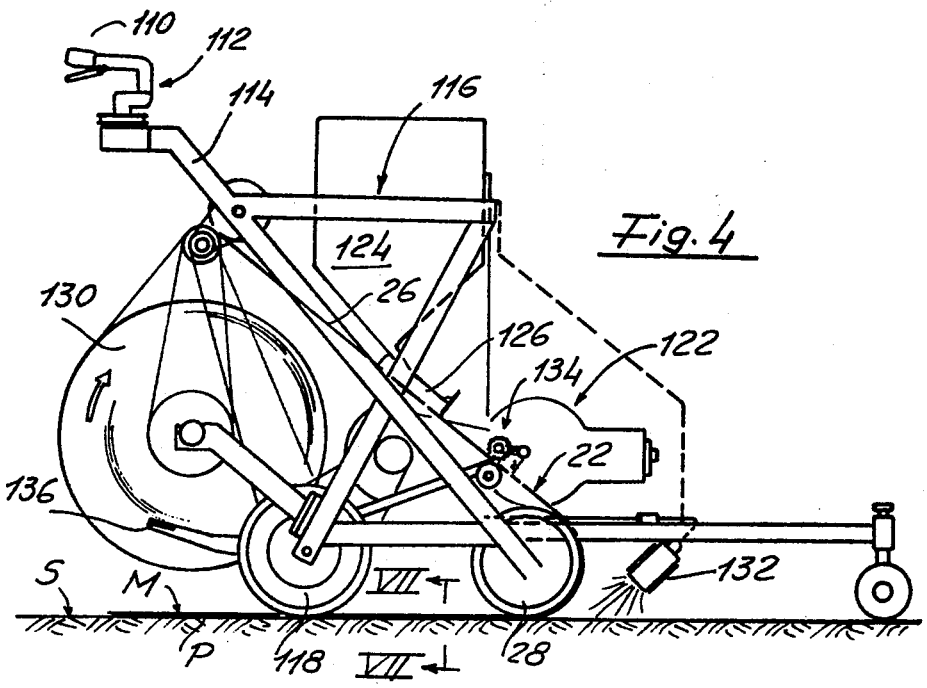
Fig. 4
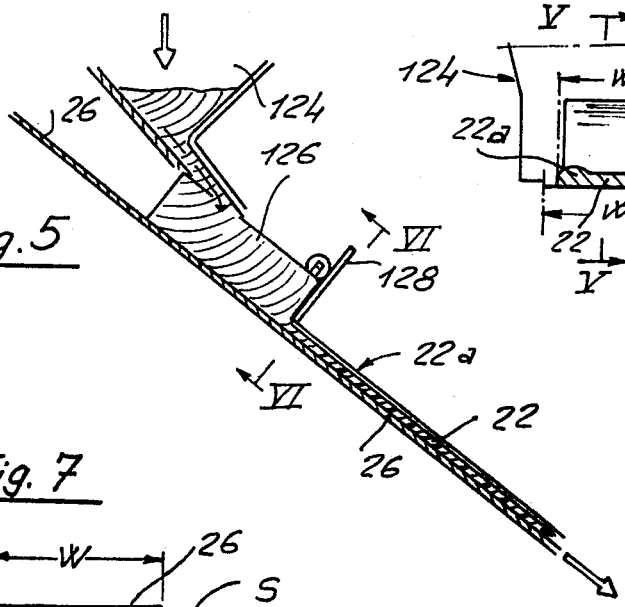
Fig. 5
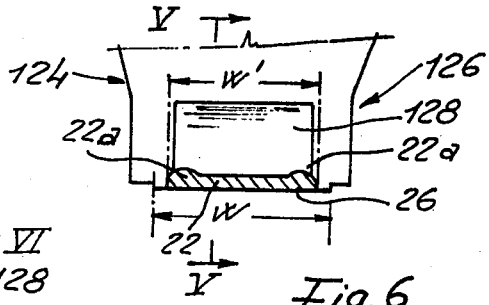
Fig. 6
Fig. 7
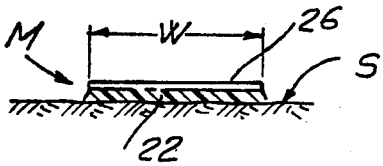

METHOD AND DEVICES FOR APPLYING TAPE MARKING MATERIAL ON ROAD SURFACES

BACKGROUND OF THE INVENTION

1. Field of the Invention

This invention relates to the art of marking of traffic dividing lines and other directional data on the surface or pavement on streets or highways, by applying on and securing prefabricated road marking tape material to said pavement, and of providing a marked road thereby. More particularly this invention is concerned with a new and improved advantageous method for applying road marking tape material on said pavement and with means for carrying on said method. Still more particularly, this invention relates to the art for applying prefabricated tape material to road pavements by means of a base or "primer" layer of generally thermoplastic composition compatible with that of usual road pavements and forming an intermediate layer between the marking tape and the said road pavement.

2. Description of the Prior Art

This art is a well worked one and widely known. Marking strips and equivalent signs on paved surfaces open to vehicle traffic are a traffic aid of paramount importance for traffic regulation and safety. The particular art with which this invention is concerned, is the method in which the laying down and securing on said surface a prefabricated tape of sign-forming material is generally complemented by preliminarily forming on said surface, a tape receptive layer.

A rather wide literature illustrates such art. For example, the U.S. Pat. No. 3,262,375 granted to the instant applicant (consistent with British patent specification No. 1,038,385) has taught how to form an essentially bituminous base or primer layer on the road surface for best subsequent applying of the marking tape. More recently, this art has been substantially improved as to the methods, the apparatuses and the materials made use of. Among the others, the U.S. Pat. Nos. 3,902,939, 3,964,559 and 3,964,835, all granted to the instant applicant (consistent in part with the British patent specifications Nos. 1,419,784 and 1,421,483) have taught some modified method and means for applying road marking tape material on a primer layer. The disclosures of said patents is assumed to be herein incorporated for a more exhaustive knowledge of the art and of the related patent literature as cited and made of record in said patents.

The extensive experimentation and the wide use on the roads of said sign-forming tapes have confirmed the criticality of providing a rather consistent primer layer on the road pavement as a base for the tape material. This provision has however made the road marking procedure a two-phase process including (a) the forming of the primer layer and (b) the laying of the tape material on said layer. The securing of the primer layer on the pavement, said layer being of an essentially bitumen-based thermoplastic composition, leads to pouring and doctoring on a preliminarily dried and heated road pavement a hot and fluidized composition capable of permeating the pavement pores. The laying and pressing of the tape on said layer requires that same layer has gelled or cooled down substantial solidification to resist to the pressure and to lock the sign on the road. A substantial time interval is therefore believed to be necessary between the two phases.

Additionally, the tape must be exactly applied on the preliminarily formed primer layer. Some misalignments however occur and for taking them into account the said layer must be formed at a safe extra width. This latter provision leads to extra costs and the uncovered side portions of the primer layer foul the tape applying roller means and prejudice the neatness of the sign.

SUMMARY OF THE INVENTION

It is therefore object of this invention to provide a new and advantageous steps and means which are not subject to the above and other limitations and by which a most safe, fast and efficient road marking strips can be formed by applying sign-forming prefabricated tape material on road pavements, by means of an intermediate primer layer, principally but not exclusively of thermoplastic nature.

In its broadest concept, the invention comprises preliminarily applying or forming a primer layer on the lower face of the tape material (the term "lower face" will define hereinbelow and in the appended claims the face which shall be down-turned as the tape is being and has been laid on the road pavement) to provide a two-layer structure, and then applying the thus formed structure to the road pavement, means and steps being provided for ensuring a prompt, complete and firm bonding at the tape-primer layer and at the primer layer-road pavement interfaces.

The above principles of the invention can be applied and made use of in a variety of arrangements either one of which can be considered as preferred in view of specific requirements, procedures and local condizions in which the marking of roads is to be performed. The above and other objects, advantages and features of the invention will be now made apparent by the following detailed description of few exemplary but not limitative embodiments of this invention, the description being referred to the accompanying drawings.

BRIEF DESCRIPTION OF THE DRAWINGS

FIG. 4 is a structurally simplified elevational view of a device adapted for forming the sign of FIG. 1, according to one embodiment of the method of the invention;

FIG. 5 illustrates in larger scale a detail of the device of FIG. 4, in cross-sectional view taken in the longitudinal plane indicated at V—V in FIG. 6, wherein the same detail is shown in cross-sectional view taken in the plane and direction indicated at VI—VI in FIG. 5, and FIG. 7 illustrated in larger scale and detail the sign as applied and formed on the road, in cross-sectional view taken in the plane indicated at VII—VII in FIG. 4.

DESCRIPTION OF THE PREFERRED EMBODIMENTS

Figure 1:
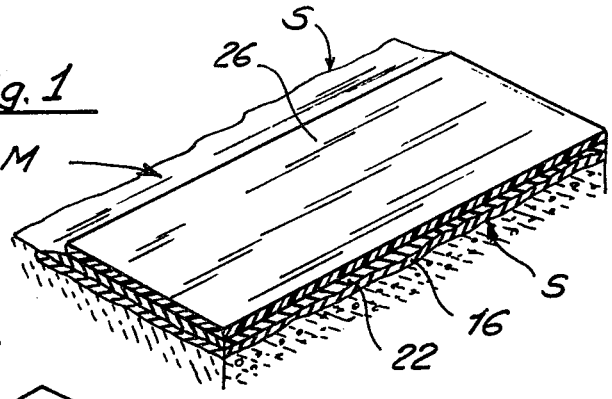
FIG. 1 is a diagrammatical perspective fragmentary view of a traffic regulating sign formed according to the invention.
Figure 2:
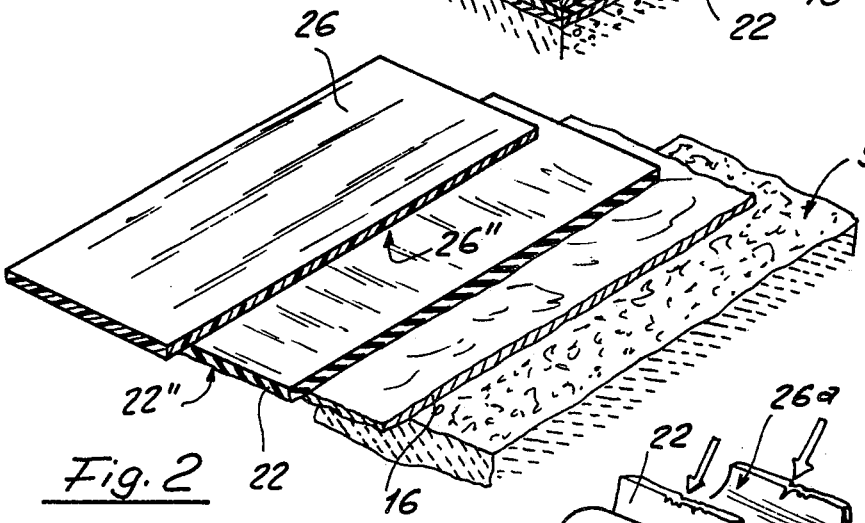
FIG. 2 is a theoretical exploded view of the essential components of the composite structure of FIG. 1.

As shown in FIGS. 1 and 2, a marking such as generally indicated at M is formed on a road pavement surface S by applying thereon a primer layer 22 on which a prefabricated sign-forming tape material 26 has been preliminarily applied, or more properly, to the lower face 26″ of which primer layer-forming layer 22 has preliminarily been applied and secured. The compositions of said primer layer, most preferably of well known thermoplastic nature, such as a bitumen-based compound, and of said tape, and the complementary features of said tape, designed for improving its traffic wear resistance, good adherence to the vehicles tires and preferably nighttime visibility, will not be detailedly indicated as well known and not forming part of this invention.

Figure 3:
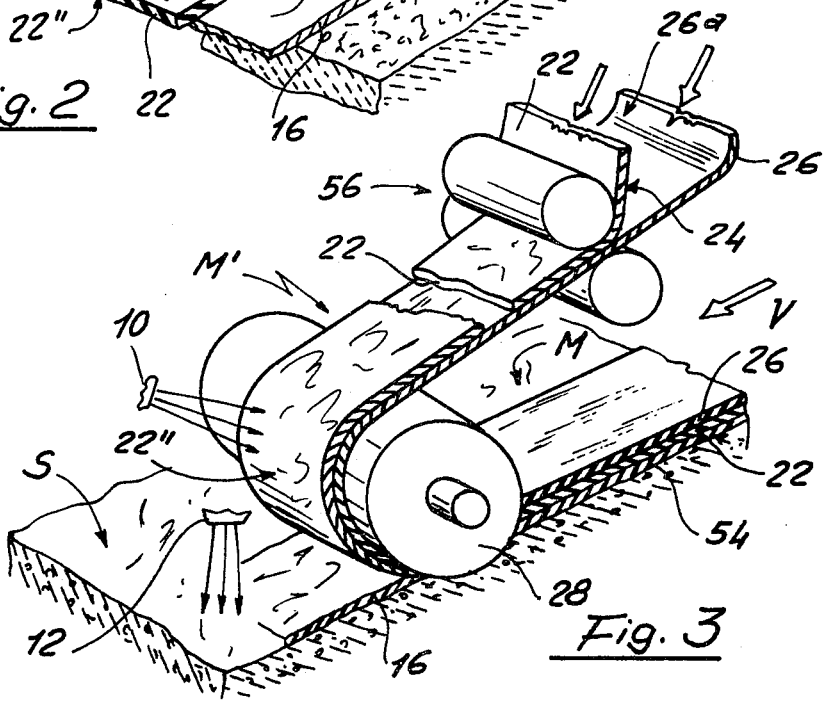
FIG. 3 is a diagrammatical perspective view of the applying and forming of the sign according to FIG. 1.

Preferably, the lower face 22" of the primer layer and/or the road surface S are provided with a thin layer of a known wetting and hydrophilous (hydrophilic) agent, applied such as by means of known spray means such as indicated at 10 and 12 in FIG. 3, to form a very thin layer 16 which facilitates the impregnation of the surface layer of the road pavement. Such layer 16 has been indicated in FIGS. 1 to 3 as of a rather consistent thickness but actually such interlayer does not exist in the formed sign because the said wetting liquid agents are subject to interdiffusion in the interfaced materials, as known to those skilled in the art, the wetting agents acting essentially as a "mordant" 54 in the interfacial area of the juxtaposed components S and 22.

Therefore, the generally tapelike material which is actually applied on the road surface S, generally by means of well known roller means such as diagrammatically indicate at 28, is a two-layer structure comprising the components 22 and 26. According to an embodiment of the invention, such composite material, generally indicated at M' in FIG. 3, is prefabricated, that is the layers 22 and 26 are factory compounded, extruded and calendered and then juxtaposed and firmly joined to each other, upon heat and pressure and, if expedient by using a mordant or a suitable binder, and the two-layer material is supplied in coils or bobbins to the road marking apparatus. A sheet or tape of thin plastic, such as polyethylene or of waxed paper can be would together the material for preventing the adjacent coils to stick with each other. The upper right portion of FIG. 3 suggests at 56 the preliminary joining of the layers 22 and 26 to form the two-layer material M'. Such joining and forming might also be performed in the same road marking apparatus, if expedient. In such occurrence the sign-forming and the primer layer-forming materials can be supplied in form of separate coils. This modified embodiment of the invention can be sometimes preferred, because it allows a more proper selection of the nature and/or the thickness of the primer layer-forming material for best adaptation of the material M' to the nature, status and unevenness of the road surface.

FIGS. 4 to 7 illustrate a further modified embodiment of the invention, according to which the tape material 26 is provided with a preliminarily applied primer layer 22 formed and applied in the same road marking apparatus. Such apparatus can for example comprise a frame structure 116 having extensions 114 having secured thereto handle means 12 provided with operator actuable controls 110. The apparatus is roadable upon driving wheels 118 and front wheel means consisting of same material applying roller means 28; a motor 122 is provided for actuating the apparatus. By means of suitable brace and bearing means, the frame 116 rotatably and replaceably supports a bobbin (or a plurality of bobbins) 130 which provides the supply of the sign-forming tape 26 and guide means (such as idle or eventually driven roller or pulley means) for guidedly progressing the tape 26 towards and about the roller 28.

Along the path of said tape 26, upstream of the roller 28, a substantial length of running tape 26 is guidedly supported to form a straight downwardly inclined leg. A primer composition applying device 126 is positioned above and in flush with the straight portion of the running tape 26 to form and doctoring the desired layer 22 on the face of said tape which will be down-turned about the roller 28. Said device 126 is continuously supplying with molten composition by a heat insulated container 124 located thereabove and wherein a batch of said molten composition is loaded at time intervals. When a bigger and more powerful apparatus is provided, such apparatus can comprise a melting unit for suppling the desired molten material.

The device 126 is, as individually considered, known in the art. Apart from its new arrangement, such device can be substantially constructed as shown in FIGS. 6 and 7 of the U.S. Pat. No. 3,964,835 granted to the instant applicant. In the embodiment of FIGS. 5 and 6 of this invention, the material doctoring action is performed by an adjustable doctoring wall 128 under which the material 22 is caused to meteredly flow over the tape 26. The opening provided below said wall 128 is of width W' smaller than the width W of the tape 26, so that the molten or more properly the heat plastified material 22 does not cover the entire width of the tape (FIG. 6) and does not drop over the edges thereof. Further, the doctoring edge of the wall 128 is shaped to impart to the doctored material 22 a cross-sectional configuration including side bulges **22*a*. Such bulges 22*a* will be flattened and sidewardly squeezed off when the layer 22 is pressed beneath the tape 26 when passing about and under the roller 28, so that, in the material M on the road surface S (FIG. 7) the tape 26 will be properly supported by a primer layer 22** uniformly pressed and extended therebelow for the entire width W thereof, without undue excess.

The marking sign applying machine is suitably complemented by one or more burners 132 (FIG. 4) located and directed for applying to the road surfaces S and/or to the lower face of the primer layer 22 the heat necessary for promoting a substantial incipient surface melting of said layer where it is being contacted with and pressed on the road surface S for ensuring the desired copenetration in the pores and cavities of said surface. The machine is further complemented by a proper known marking tape transversely cutting or severing device such as diagrammatically shown and generally indicated at 134, said device being for example actuated by the operator (who walks behind the apparatus) acting for example on a control pedal 136.

Any suitable essentially thermoplastic composition can be made use of for forming the primer layer 22 and, if any, the wetting layer 16. This latter composition can be of the two-component type for ensuring prompt gelling when two reactives are contacted with each other. A not limitative example of a composition adapted for forming a thermoplastic primer layer 22 comprises, in parts by weight:

"Versamid 940" (Schering): parts 65
"Versamid 100" (as above): parts 5
Vinylethylene acetate copolymer (such as "Elvax 240"): parts 20
Colophony ester (such as "Foral 85" by DuPont): parts 10
Oxidized bitumen: parts 200

The wetting liquid having hydrophilous properties, made use of for forming the interlayer 16, can comprise mixtures of epoxy resins and epoxy tar, catalysts and reaction accelerators. A suitable two-component ("A" and "B") can comprise, in parts by weight:

"A" Epoxy resin (such as "Araldite G 7 250"): parts 260
Epoxy tar: parts 100
"B" Catalyst for the resin (such as "Ankamine XT"): parts 65
Accelerator for same (such as "D M P 30"): parts 20
Epoxy tar: parts 115
Cresylic acid: parts 100

I claim:

1. A method of forming a traffic-regulating indicium on a road surface, comprising the sequential steps of melting an at least predominantly thermoplastic primer; firmly bonding the molten primer as a layer to a face of a tape to thereby form a two-layered indicium band; and pressing said indicium band down against the road surface while the primer layer is in an at least partially molten condition and with sufficient force to drive the primer layer into pores and cavities of the road, said previous step of bonding being performed by spreading the molten priner over only a portion of the width of the face of the tape so as to retain substantially all of the primer layer under the face of the tape despite squeezing of the primer layer during said pressing step.

2. A method as defined in claim 1, further comprising the step of directing said indicium band to the road surface over a sufficiently long period of time for the thermoplastic primer layer to gell so as to attain a viscosity sufficient to substantially withstand pressure applied during said pressing step; and reheating the lower face of the thermoplastic primer layer prior to said step of pressing so as to fluidize the lower face of gelled primer layer and thereby promote penetration of the primer layer into pores and cavities of the road surface.

3. A method as defined in claim 1; further comprising applying a layer of a hydrophilic agent to the lower face of the primer layer prior to said step of pressing so as to facilitate penetration of the primer layer into the pores of the road surface.

4. A method as defined in claim 2; further comprising the step of winding said two-layered indicium band onto a bobbin, wherein said step of directing is performed by unwinding said indicium band from the bobbin.

5. A method as defined in claim 1, the thermoplastic primer including oxidized bitumen.

6. A method as defined in claim 5, the thermoplastic primer being about $\frac{2}{3}$ by weight of oxidized bitumen.

7. A method as defined in claim 1, said step of bonding being performed by directly contacting the primer with the face of the tape.

* * * * *